US009676087B2

(12) United States Patent
Yang

(10) Patent No.: US 9,676,087 B2
(45) Date of Patent: Jun. 13, 2017

(54) PAIR OF CIRCLIP PLIERS

(71) Applicant: Hsin-Hung Yang, Taichung (TW)

(72) Inventor: Hsin-Hung Yang, Taichung (TW)

( * ) Notice: Subject to any disclaimer, the term of this patent is extended or adjusted under 35 U.S.C. 154(b) by 329 days.

(21) Appl. No.: 14/604,114

(22) Filed: Jan. 23, 2015

(65) Prior Publication Data

US 2016/0214246 A1 Jul. 28, 2016

(51) Int. Cl.
*B25B 27/20* (2006.01)
*B25B 7/10* (2006.01)

(52) U.S. Cl.
CPC ..... *B25B 27/205* (2013.01)

(58) Field of Classification Search
CPC ..... B25B 27/205; B25B 27/20; B25B 7/10; B25B 7/12; Y10T 29/5363
See application file for complete search history.

(56) References Cited

U.S. PATENT DOCUMENTS 2,546,616 A * 3/1951 Schaaff ..... B25B 27/205 29/229
4,476,750 A * 10/1984 Murphy ..... B25B 27/205 29/229
5,826,467 A * 10/1998 Huang ..... B25B 7/06 29/229
6,792,837 B2 * 9/2004 Battistone ..... B25B 27/205 29/229
6,983,677 B1 * 1/2006 Engel ..... B25B 27/205 29/229
8,919,227 B2 * 12/2014 Tseng ..... B25B 7/16 29/229
8,960,057 B2 * 2/2015 Zeng ..... B25B 27/205 81/302

* cited by examiner

*Primary Examiner* — David B Thomas

(74) *Attorney, Agent, or Firm* — C. G. Mersereau; Nikolai & Mersereau, P.A.

(57) ABSTRACT

A pair of circlip pliers includes two handles, two jaws and two switching boards. The handles are symmetrical to a longitudinal axis and are arranged at a horizontal interval. The jaws are symmetrical in shape, are mounted between the handles, abut each other, and are pivotally connected with the handles. The switching boards are respectively and pivotally connected with the handles. The pair of circlip pliers can be applied as an expanding type circlip plier or a squeezing type circlip plier to allow a user to change the state of the pair of circlip pliers for different purposes.

5 Claims, 7 Drawing Sheets

PAIR OF CIRCLIP PLIERS

BACKGROUND OF THE INVENTION

1. Field of the Invention

The present invention relates to a hand tool, and more particularly to a pair of circlip pliers.

2. Description of Related Art

A conventional circlip plier is used to remove a circlip from a shaft or a tube. The circlip plier includes a pair of handles for holding and a pair of jaws respectively formed on the handles for clamping circlips. In order to remove an internal circlip or an external circlip, two different types of conventional circlip plier are provided, including an expanding type and a squeezing type. In normal state of the expanding type circlip plier, the jaws of the circlip plier are closed. When the expanding type circlip plier is in use, the handles of the circlip plier are pressed to each other and the jaws of the circlip plier are opened to expand an external circlip for removal from a shaft. Contrary to the expanding type circlip plier, the squeezing type circlip plier is used to squeeze an internal circlip to be removed from a tube.

However, the two different types of the circlip pliers are for different types of circlips, such that a user has to change between the different circlip pliers frequently for clamping different types of circlips and this is very inconvenient in use.

To overcome the shortcomings of the conventional circlip plier, the present invention provides a pair of circlip pliers to mitigate or obviate the aforementioned problems.

SUMMARY OF THE INVENTION

The main objection of the present invention provides a pair of circlip pliers having two operation states.

The complex circlip plier includes two handles, two jaws and two switching boards. The handles are symmetrical to a longitudinal axis and are arranged at a horizontal interval. The jaws are symmetrical in shape, are mounted between the handles, abut each other, and are pivotally connected with the handles. The switching boards are respectively and pivotally connected with the handles.

The pair of circlip pliers has two different operation states to allow a user to switch between the two states for different purposes.

Other objects, advantages, and novel features of the invention will become more apparent from the following detailed description when taken in conjunction with the accompanying drawings.

DETAILED DESCRIPTION OF PREFERRED EMBODIMENT

Figure 1:
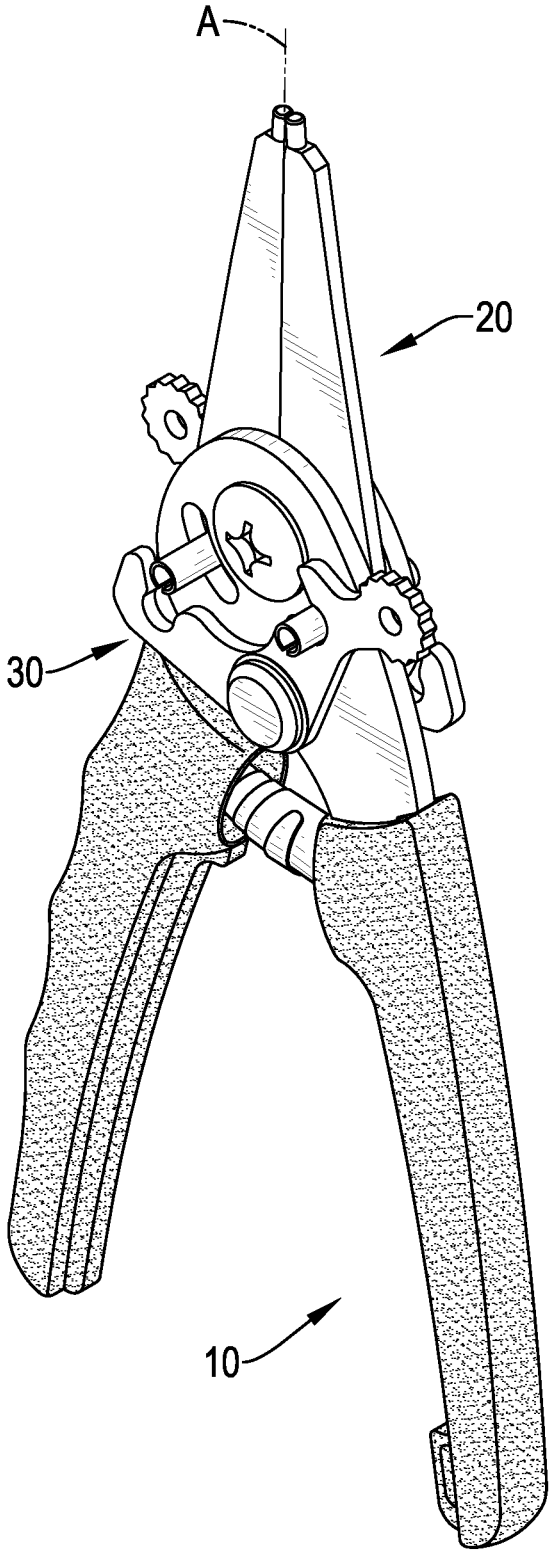
FIG. 1 is a perspective view of a pair of circlip pliers in accordance with the present invention.
Figure 2:
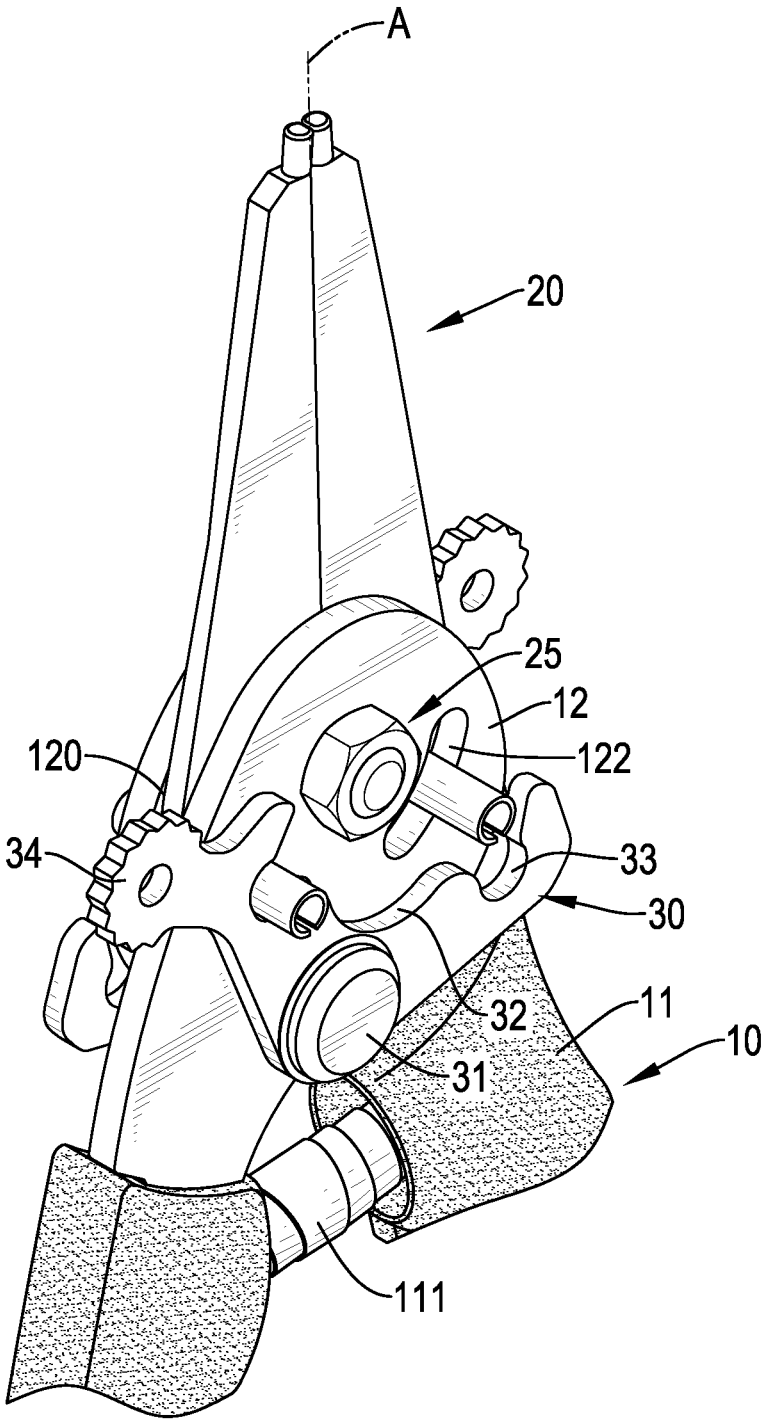
FIG. 2 is an enlarged perspective view of the pair of circlip pliers in FIG. 1.
Figure 3:
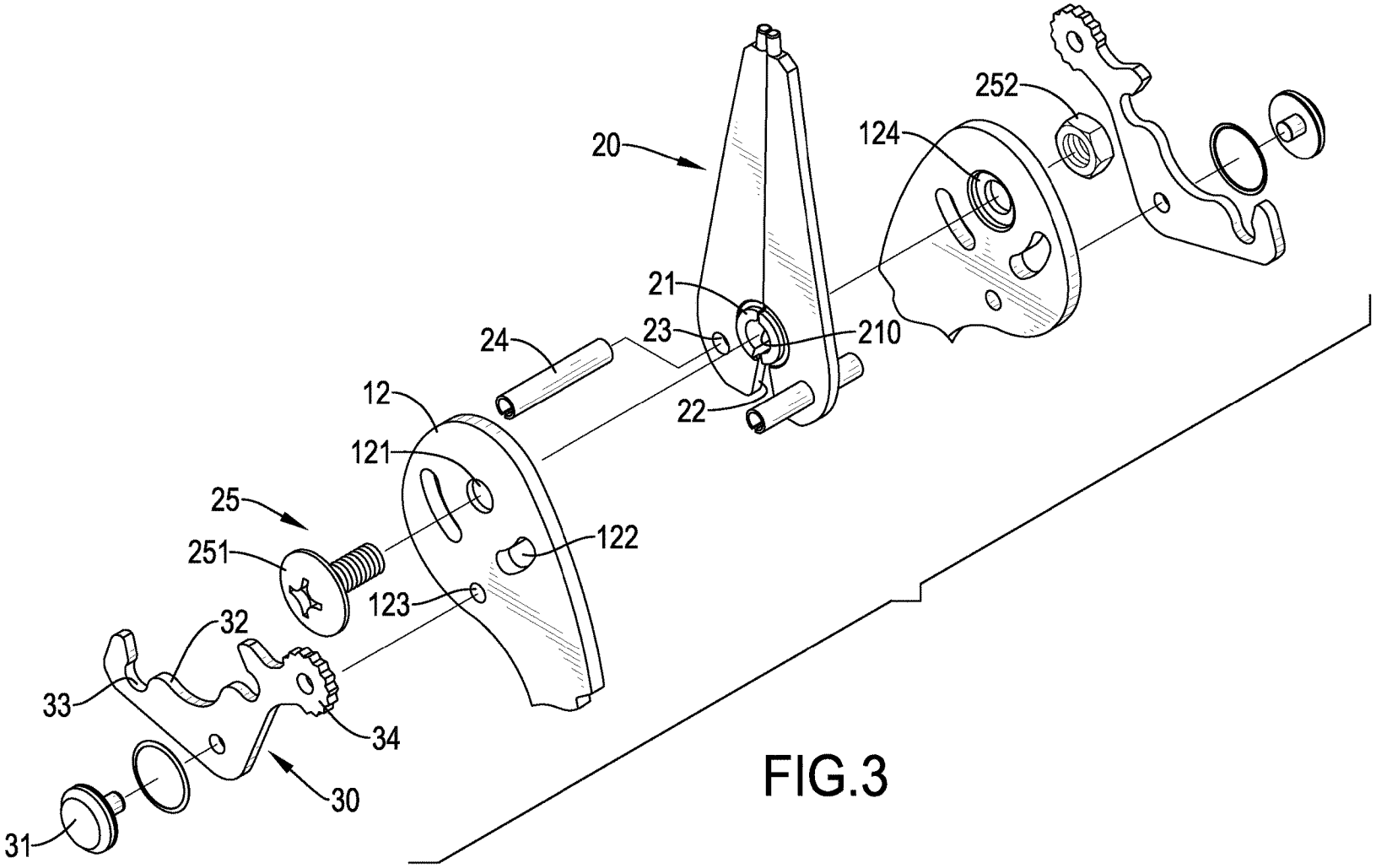
FIG. 3 is an enlarged exploded perspective view of the pair of circlip pliers in FIG. 1.

With reference to FIGS. 1, 2 and 3, a preferred embodiment of a pair of circlip pliers includes two handles 10, two jaws 20 and two switching boards 30.

The handles 10 are symmetrical to a longitudinal axis A and are arranged at a horizontal interval. Each handle 10 includes a griping portion 11 and an adjusting portion 12. A spring 111 is connected between the griping portions 11 of the handles 10. The adjusting portion 12 is a round plate, is formed on the top of the griping portion 11 and has a pivot hole 121, two sliding holes 122, a fixing hole 123 and a ring recess 124. The adjusting portions 12 of the handles 10 are arranged at a horizontal interval and a gap 120 is formed between the adjusting portions 12. The pivot hole 121 is formed though the adjusting portion 12. The sliding holes 122 are arc-shaped, are formed through the adjusting portion 12 and are respectively located at right and left sides of the pivot hole 121. The sliding holes 122 in each handle 10 correspond in position respectively to the sliding holes 122 in the other handle 10. The fixing hole 123 is formed through the adjusting portion 12 and located under the pivot hole 121. The ring recess 124 is formed around the pivot hole 121 and is located at an inner surface of the adjusting portion 12.

With reference to FIGS. 1, 2 and 3, the jaws 20 are symmetrical in shape, are mounted in the gap 120, abut each other, and are pivotally connected with the handles 10. Each jaw 20 has a flange 21, a notch 22, a mounting hole 23, a rod 24 and a pivot unit 25. The flange 21 is semi-circular, protrudes from both sides of each jaw 20, is located adjacent to a side edge of the jaw 20 and respectively abuts the ring recess 124 of a corresponding handle 10. A through hole 210 is formed between the flanges 21 of the jaw 20 and corresponds to the position of the pivot holes 121 of the handles 10. The notch 22 is formed in a bottom edge of the jaw 20. The mounting hole 23 is formed through the jaw 20, is located adjacent to the notch 22 and corresponds to the position of the sliding holes 122 of the corresponding handle 10. The rod 24 is mounted through the mounting hole 23 of the jaw 20 and has two ends. The ends of the rod respectively protrude from the two sides of the jaw 20 and are respectively mounted through two corresponding sliding holes 122 of the handles 10.

The pivot unit 25 includes a screw 251 and a nut 252. The screw 251 is mounted through the through holes 210 of the jaws 20 and the pivot holes 121 of the handles 10. The nut 252 is screwed with the screw 251 to pivotally connect the jaws 20 with the handles 10.

With reference to FIGS. 1, 2 and 3, the switching boards 30 are L-shaped and are respectively and pivotally connected with the fixing holes 123 of the handles 10 by a pivot screw 31. Each switching board 30 has an escaping recess 32, two engagement recesses 33 and a switching portion 34. The escaping recess 32 is formed in a top surface of the switching board 30 and corresponds to the position of the pivot unit 25. The engagement recesses 33 are formed in the top surface of the switching board 30, are respectively located at the left and right ends of the switching board 30 and correspond to the locations of the rods 24 of the jaws 20. The switching portion 34 is toothed and formed on the right end of the switching board 30. The switching portion 34 can be pushed down or pulled up to switch the position of the switching boards 30, and then one of the engagement recesses 33 can correspondingly engage one of the rods 24 of the jaws 20 to change the usage state of the circlip plier.

Figure 4:
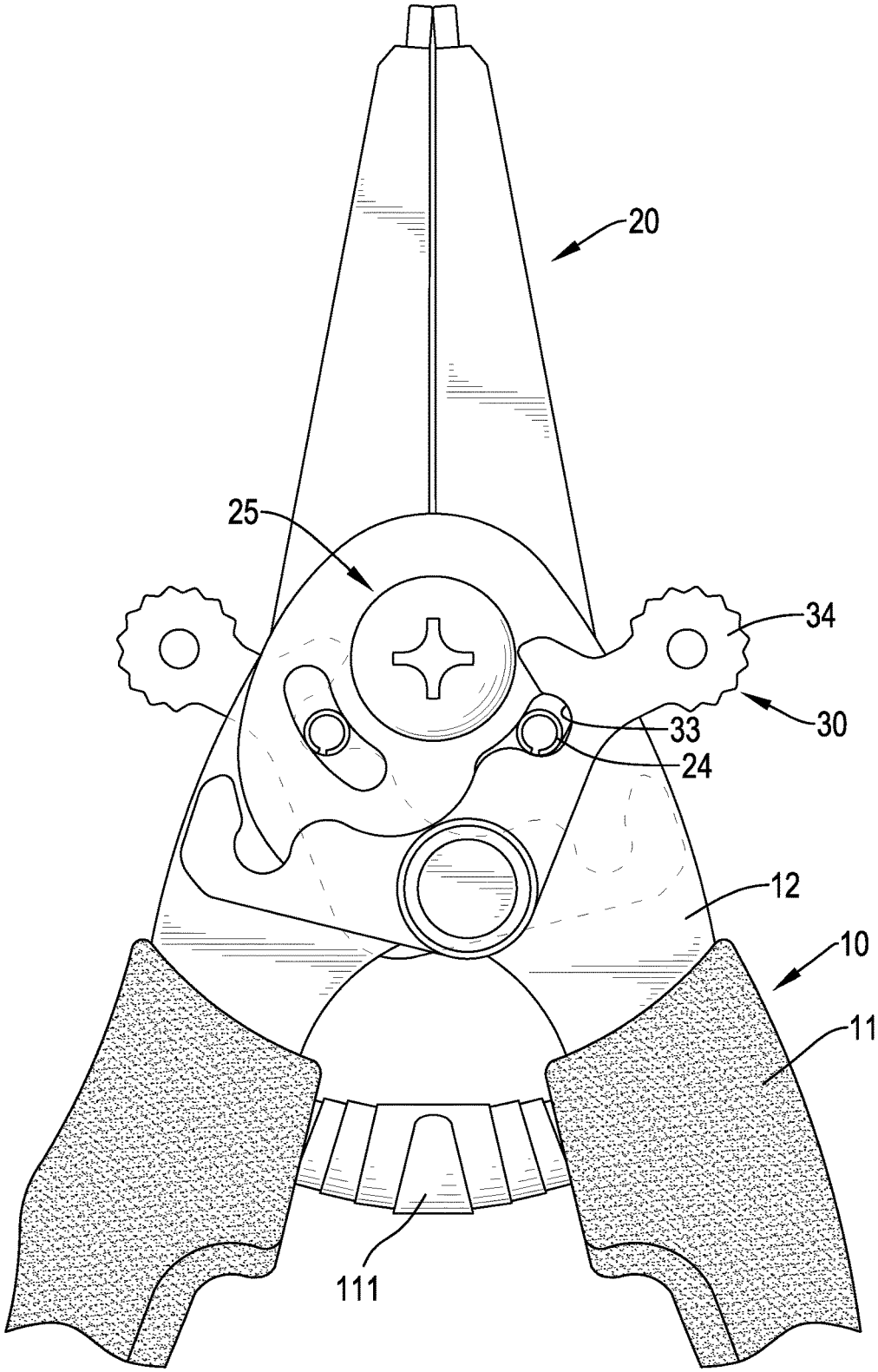
FIG. 4 is an enlarged front view of the pair of circlip pliers in FIG. 1 in an expanding state.

With reference to FIG. 4, the pair of circlip pliers is in the expanding state when the engagement recess 33 at the right side of each switching board 30 engages the rod 24 at the right side of each jaw 20. The right side handle 10 can control the right side jaw 20 because the switching boards 30 are connected with the right side rods 24.

Figure 5:
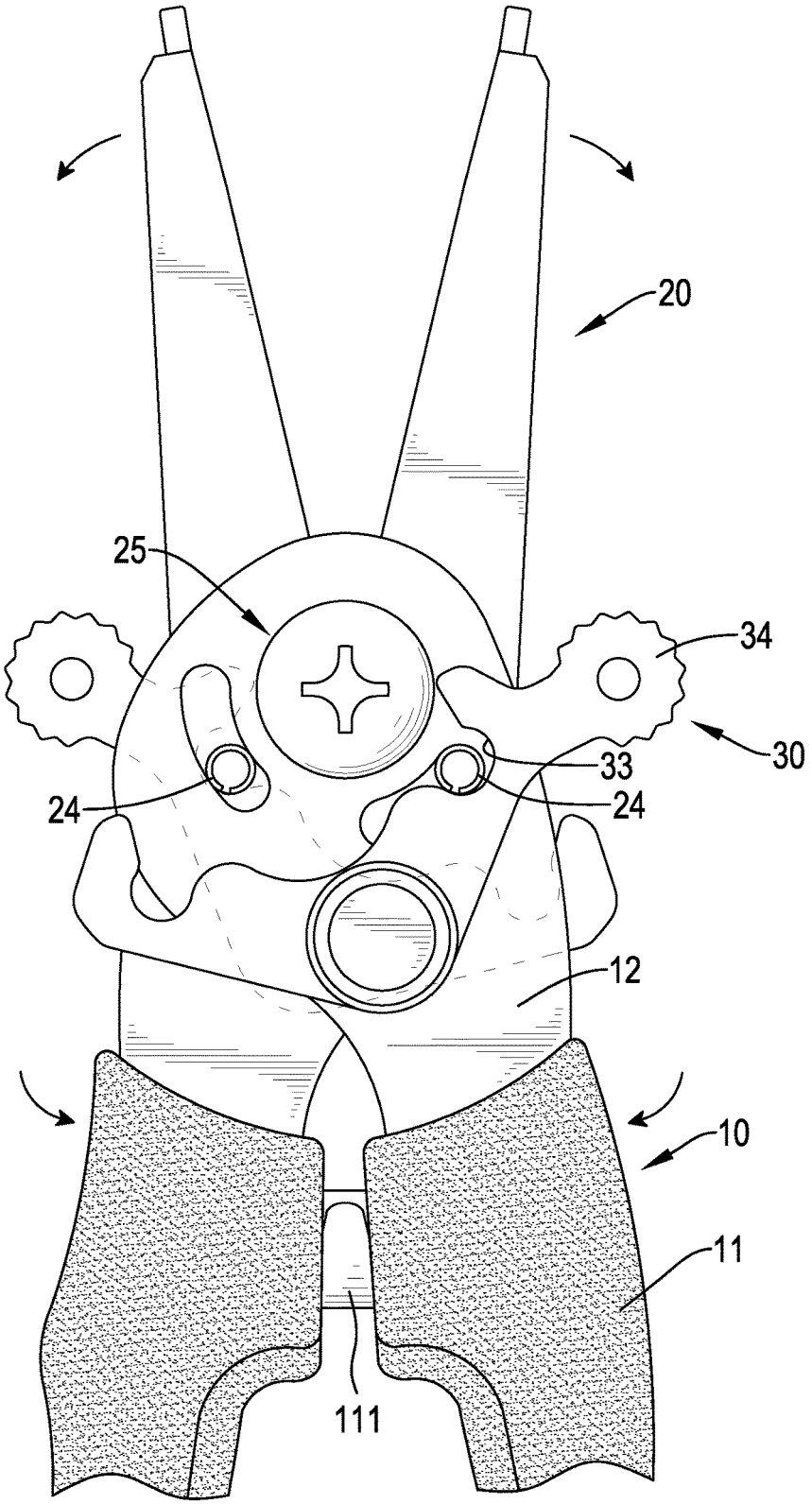
FIG. 5 shows an operational front view of the pair of circlip pliers in FIG. 4.

With reference to FIG. 5, when the handles 10 are pressed, the jaws 20 depart from each other for removing an external circlip.

Figure 6:
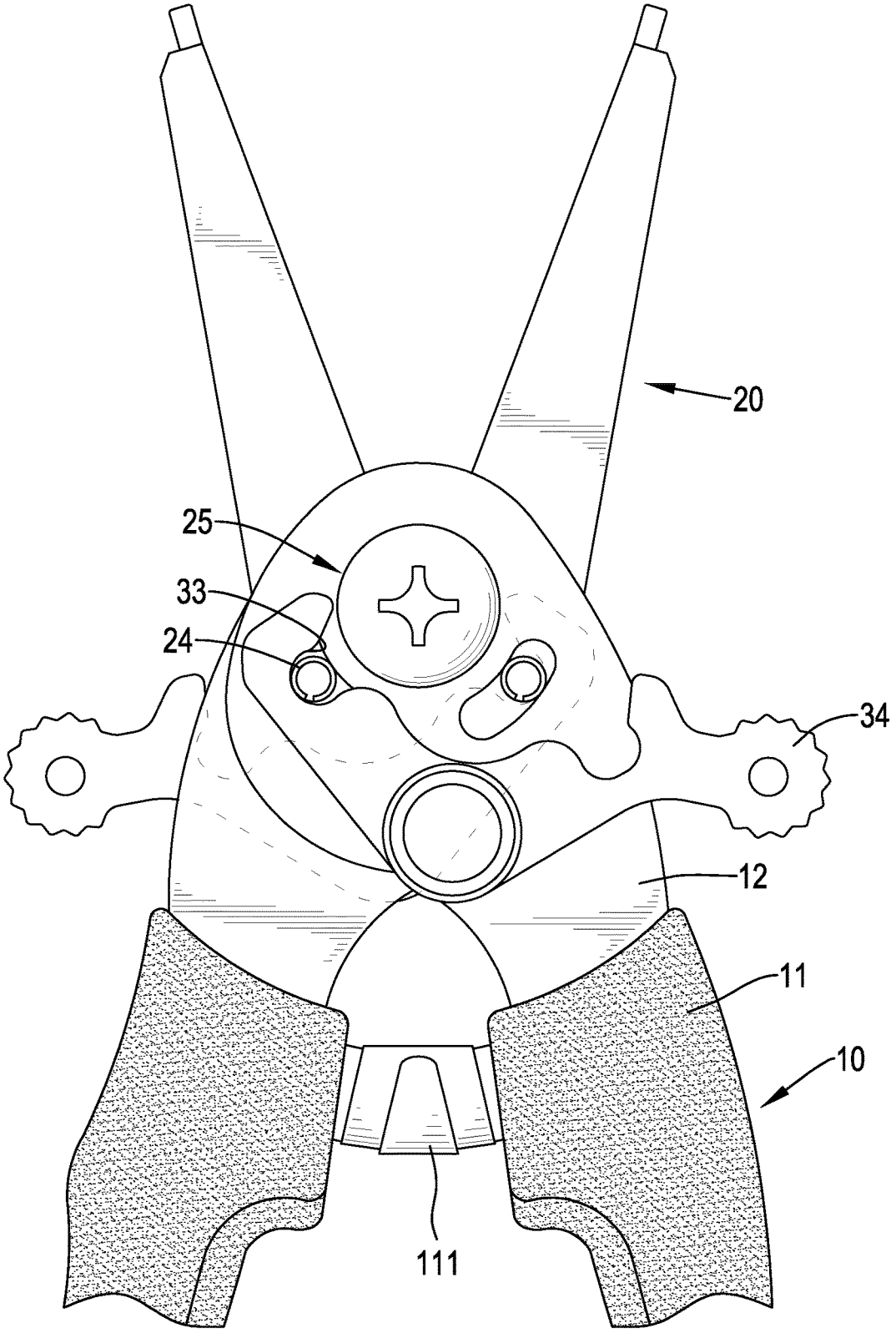
FIG. 6 is an enlarged front view of the pair of circlip pliers in FIG. 1 in a squeezing state.

With reference to FIG. 6, when the switching portions 34 of the switching boards 30 are pulled down, the engagement recess 33 at the left side of each switching board 30 engages the rod 24 at the left side of each jaw 20, the state of the pair of circlip pliers is changed to the squeezing type. Therefore, the right side handle 10 can control the left side jaw 20 because the switching boards 30 are connected with the left side rods 24. The jaws 20 are separated apart from each other in normal state.

Figure 7:
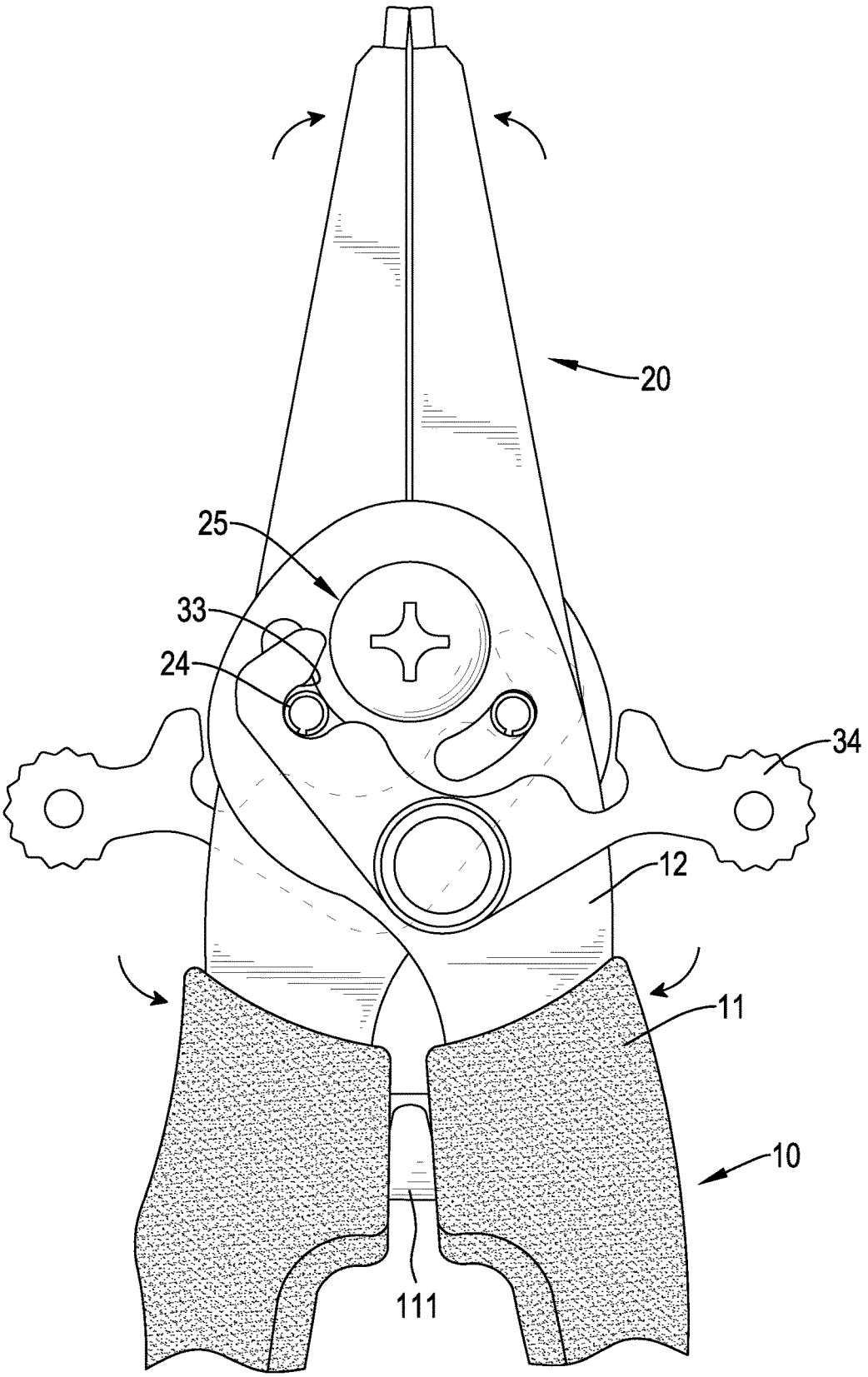
FIG. 7 shows an operational front view of the pair of circlip pliers in FIG. 6.

With reference to FIG. 7, when the handles 10 are pressed, the jaws 20 are pressed to each other for removing an internal circlip.

Accordingly, the pair of circlip pliers can be applied for an expanding type circlip plier or a squeezing type circlip plier. A user can switch the switching boards 30 to connect one of the rods 24 of the jaws 20 and change the state of the pair of circlip pliers for different purposes so as to reduce the time of changing tools and the equipment cost.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pair of circlip pliers comprising:

two handles being symmetrical to a longitudinal axis and arranged at a horizontal interval, each handle including a griping portion; and an adjusting portion formed on a top of the griping portion and having two sliding holes being arc-shaped and formed through the adjusting portion; wherein the adjusting portions of the handles are arranged at a horizontal interval, a gap is formed between the adjusting portions, and the sliding holes in each handle correspond in position respectively to the sliding holes in the other handle;

two jaws being symmetrical in shape, mounted in the gap between the adjusting portions of the handles, abutting each other, and pivotally connected with the handles, and each jaw having a notch formed in a bottom edge of the jaw; and a rod mounted through the jaw and having two ends; the ends of the rod respectively protruding from two sides of the jaw and respectively mounted through the two corresponding sliding holes of the handles; and two switching boards respectively and pivotally connected with the adjusting portions of the handles, each switching board having an escaping recess formed in a top surface of the switching board; and two engagement recesses formed in the top surface of the switching board, respectively located at two ends of the switching board and corresponding to the locations of the rods.

2. The pair of circlip pliers as claimed in claim 1, wherein each adjusting portion has a pivot hole formed through the adjusting portion; and a ring recess formed around the pivot hole and located at an inner surface of the adjusting portion;

each jaw has a flange being semi-circular, protruding from the sides of the jaw, located adjacent to a side edge of the jaw, and respectively abutting the ring recess of the corresponding handle.

3. The pair of circlip pliers as claimed in claim 2, wherein each jaw has a mounting hole formed through the jaw, located adjacent to the notch in the jaw and corresponding to the position of the sliding holes of the handle; and the rods are detachably and respectively mounted through the mounting holes of the jaws.

4. The pair of circlip pliers as claimed in claim 3, wherein each switching board has a switching portion being toothed and formed on one of the ends of the switching board.

5. The pair of circlip pliers as claimed in claim 4, wherein a spring is connected between the griping portions of the handles.

* * * * *